US007137780B2

(12) United States Patent
Liang

(10) Patent No.: US 7,137,780 B2
(45) Date of Patent: Nov. 21, 2006

(54) INTERNAL COOLING SYSTEM FOR A TURBINE BLADE

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 81 days.

(21) Appl. No.: 10/871,473

(22) Filed: Jun. 17, 2004

(65) Prior Publication Data

US 2005/0281674 A1 Dec. 22, 2005

(51) Int. Cl.
*F01D 5/18* (2006.01)

(52) U.S. Cl. ..... 416/90 R; 416/97 R

(58) Field of Classification Search ..... 416/90 R, 416/96 R, 97 R; 415/115
See application file for complete search history.

(56) References Cited

U.S. PATENT DOCUMENTS

| | | | | |
|---|---|---|---|---|
| 4,236,870 | A | 12/1980 | Hucul, Jr. et al. | |
| 4,604,031 | A | 8/1986 | Moss et al. | |
| 4,775,296 | A | 10/1988 | Schwarzmann et al. | |
| 5,462,405 | A | 10/1995 | Hoff et al. | |
| 5,488,825 | A | 2/1996 | Davis et al. | |
| 6,036,440 | A * | 3/2000 | Tomita et al. | 416/96 R |
| 6,077,034 | A | 6/2000 | Tomita et al. | |
| 6,099,244 | A | 8/2000 | Tomita et al. | |
| 6,139,269 | A | 10/2000 | Liang | |
| 6,186,741 | B1 | 2/2001 | Webb et al. | |
| 6,220,817 | B1 | 4/2001 | Durgin et al. | |
| 6,491,496 | B1 | 12/2002 | Starkweather | |
| 6,561,758 | B1 | 5/2003 | Rinck et al. | |
| 6,595,748 | B1 | 7/2003 | Flodman et al. | |
| 6,609,884 | B1 | 8/2003 | Harvey | |
| 6,634,858 | B1 | 10/2003 | Roeloffs et al. | |
| 2002/0106275 | A1 | 8/2002 | Harvey | |
| 2002/0119045 | A1 | 8/2002 | Starkweather | |
| 2002/0119047 | A1 | 8/2002 | Starkweather | |
| 2002/0197161 | A1 * | 12/2002 | Roeloffs et al. | 416/97 R |

FOREIGN PATENT DOCUMENTS

| | | | |
|---|---|---|---|
| EP | 1022434 | A2 | 7/2000 |
| EP | 1128024 | A2 | 8/2001 |
| JP | 2001271603 | A2 | 10/2001 |

* cited by examiner

*Primary Examiner*—Richard A. Edgar

(57) ABSTRACT

A turbine blade for a turbine engine having a cooling system with at least one serpentine cooling channel in internal aspects of the turbine blade. The serpentine cooling channel includes at least one root turn proximate to a root of the turbine blade. The root turn may have a generally rectangular shape and may account for reduced pressure losses relative to conventional curved root turns. One or more refresh holes may be positioned in a rib proximate to the root turn to provide the root turn with cooling fluids that have bypassed the first and second legs of the serpentine cooling channel.

16 Claims, 4 Drawing Sheets

INTERNAL COOLING SYSTEM FOR A TURBINE BLADE

FIELD OF THE INVENTION

This invention is directed generally to turbine blades, and more particularly to hollow turbine blades having internal cooling channels for passing cooling fluids, such as air, to cool the blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades, as shown in FIG. 1, are formed from a root portion and a platform at one end and an elongated portion forming a blade that extends outwardly from the platform. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Conventional turbine blades may have one or more root turns, as shown in FIG. 2, which are located proximate to the root. Conventional root turns are typically curved elements of the flow path that change the direction of cooling fluid flow about 180 degrees in a serpentine formation in the root. While a conventional root turn successfully redirects cooling fluid flow from flowing spanwise towards a root to flowing spanwise towards the blade tip, a conventional root turn causes the cooling fluids flowing through the conventional root turn to undergo a significant pressure loss. Such a pressure loss often causes undesirable hot spots to develop in portions of the turbine blades. Thus, an internal cooling system having reduced pressure loss cooling fluid turns is needed.

SUMMARY OF THE INVENTION

This invention relates to a turbine blade capable of being used in turbine engines and having a turbine blade cooling system for dissipating heat from the turbine blade. The turbine blade may be a generally elongated blade having a leading edge, a trailing edge, a tip at a first end, a root coupled to the blade at an end generally opposite the first end for supporting the blade and for coupling the blade to a disc, at least one cavity forming a cooling system in the blade, and at least one outer wall defining the cavity forming at least a portion of the cooling system. The cooling system includes at least one serpentine cooling channel for directing cooling fluids through internal aspects of the turbine blade.

The serpentine cooling channel may be formed from a first leg extending generally from the root towards the blade tip, a second leg in communication with the first leg and extending towards the root, and a third leg in communication with the second leg through a root turn and extending generally towards the tip. The root turn is configured to reduce the pressure loss associated with conventional root turns. For instance, the root turn may be formed from a first rib extending from the root spanwise towards the tip and separating the first and second legs, a second rib extending from the root towards the tip and forming a portion of the third leg, and a third rib extending between the first and second ribs. In at least one embodiment, the third leg may be substantially straight. The third rib may be positioned generally orthogonal to the first and third ribs. In other embodiments, the third rib may be positioned nonorthogonally to the first or second rib, or both. In at least one embodiment, the first, second, and third ribs form a generally rectangular root turn. The root turn may have different sizes, but in at least one embodiment, the root turn has a spanwise length that is at least as long as about half of a length of the second leg of the serpentine channel.

The turbine blade cooling system may also include one or more refresh holes extending between the first leg and the second leg and positioned proximate to the root turn to direct cooling fluid into the upstream portion of the root turn. The refresh hole may have a bell shaped inlet and a straight outlet. The refresh hole may also be positioned relative to a direction in which the cooling fluid is flowing through the second leg of the serpentine cooling channel such that the cooling fluid expelled from the refresh hole is directed into the root turn in the same general direction as the cooling fluid flowing through the root turn. For example, the refresh hole may be positioned between about 15 degrees and about 75 degrees relative to the direction of flow of the cooling fluid through the second leg, and, in at least one embodiment, may be positioned about 45 degrees relative to the direction of fluid flow.

The root turn advantageously reduces the pressure loss coefficient associated with conventional root turns. In fact, the root turn of the instant invention reduces a pressure loss coefficient to about 0.6 in at least one embodiment, from about 2.0 experienced in conventional designs.

Another advantage of the invention is the refresh holes reduce the total flow needed to cool a portion of a turbine blade because at least a portion of the cooling fluids do not pass through the first and second legs of the serpentine cooling channel; rather, some of the cooling fluids pass through the refresh hole and directly into the root turn. Thus, the fluid that passes through the refresh hole does not pick up heat from the first and second legs of the serpentine cooling channel. Therefore, cooling fluids are capable of being passed through the root turn and the third leg in reduced amounts, yet still accomplish the same amount of cooling.

Yet another advantage of the invention is that the root turn is easier to manufacture than many conventional root turns.

Still another advantage of the invention is that the angle at which cooling fluids are added to the root turn enables a greater amount of cooling fluid to be added to the root turn than in conventional root turns.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 3:
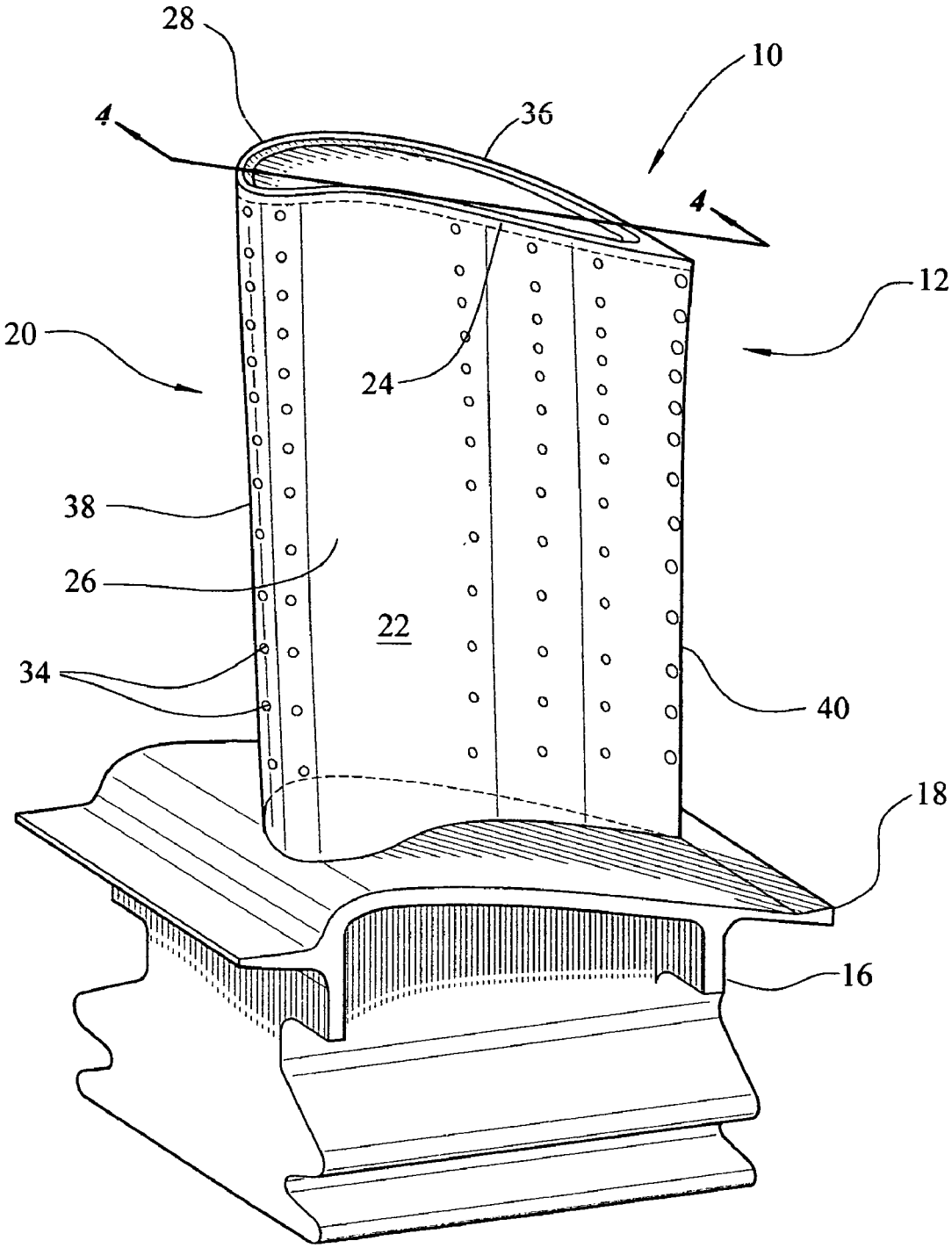
FIG. 3 is a perspective view of a turbine blade having features according to the instant invention.
Figure 4:
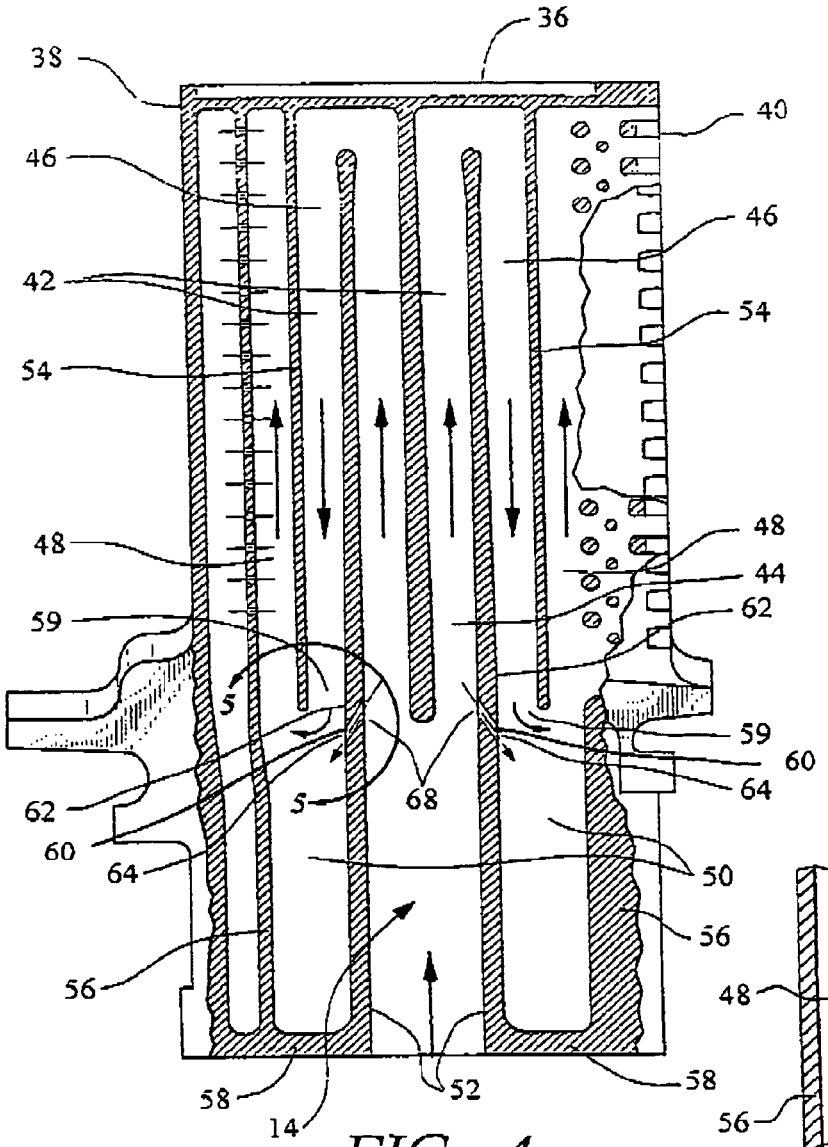
FIG. 4 is cross-sectional view of the turbine blade shown in FIG. 3 taken along section line 4—4.
Figure 5:
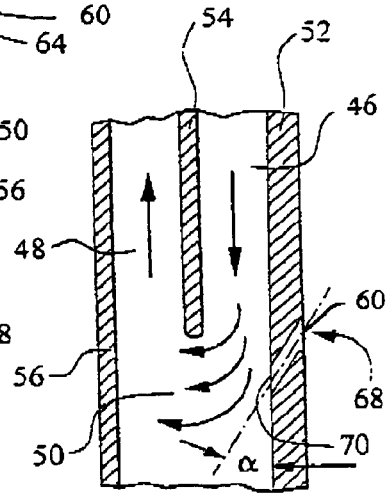
FIG. 5 is a detail of the root turn shown in FIG. 4.

As shown in FIGS. 3–5, this invention is directed to a turbine blade cooling system 10 for turbine blades 12 used in turbine engines. In particular, turbine blade cooling system 10 is directed to a cooling system 10 located in a cavity 14, as shown in FIG. 4, positioned between outer walls 22. Outer walls 22 form a housing 24 of the turbine blade 12, as shown in FIG. 3. The turbine blade 12 may be formed from a root 16 having a platform 18 and a generally elongated blade 20 coupled to the root 16 at the platform 18. The turbine blade may also include a tip 36 generally opposite the root 16 and the platform 18. Blade 20 may have an outer wall 22 adapted for use, for example, in a first stage of an axial flow turbine engine. Outer wall 22 may have a generally concave shaped portion forming pressure side 26 and may have a generally convex shaped portion forming suction side 28.

The cavity 14, as shown in FIG. 4, may be positioned in inner aspects of the blade 20 for directing one or more gases, which may include air received from a compressor (not shown), through the blade 20 and out one or more orifices 34 in the blade 20. As shown in FIG. 3, the orifices 34 may be positioned in a leading edge 38, a trailing edge 40, the pressure side 26, and the suction side 28 to provide film cooling. The orifices 34 provide a pathway from the cavity 14 through the outer wall 22.

As shown in FIG. 4, the cavity 14 forming the cooling system 10 may have at least one serpentine cooling channel 42. The exemplary turbine blade shown in FIG. 4 includes two serpentine cooling channels 42; however, for ease in discussion, only one of the serpentine cooling channels is described below. The serpentine cooling channel 42 shown in FIG. 4 is a triple pass cooling channel 42; however, the invention is not limited to this configuration. Instead, the serpentine cooling channel 42 may be formed from cooling channels having other number of passes. The serpentine cooling channel 42 may be formed from a first leg 44 extending spanwise generally from the root 16 towards the tip 36, a second leg 46 in communication with the first leg 44 and extending towards the root 16 from an end of the first leg 44 closest the tip 36, and a third leg 48 in communication with the second leg 46 via a root turn 50 and extending generally towards the tip 36. The first and second legs 44 and 46 may be separated by one or more ribs 52. Likewise, second and third legs 46 and 48 may be separated by one or more ribs 54.

The root turn 50 may be formed from the rib 52 extending spanwise from the root 16 towards the tip 36 and separating the first and second legs 44 and 46, a rib 56 extending spanwise from the root 16 towards the tip 36 and forming a portion of the third leg 48, and a rib 58 extending between the rib 52 and the rib 56. In at least one embodiment, the rib 56 may be substantially straight, as shown in FIG. 4. The rib 58 may, in at least one embodiment, be positioned generally orthogonal to ribs 52 and 56. In another embodiment, the rib 58 may be positioned nonorthogonally relative to the ribs 52 and 56. The root turn 50, as extending spanwise from the rib 58 to the rib 54, may have a spanwise length that is at least as long as about half of a spanwise length of the second leg 46 of the serpentine cooling channel 42. In at least one embodiment, a mouth 59 of the second leg 46 has a cross-sectional area that is greater than or equal to the cross-sectional area of the third leg 48 proximate to the root turn 50. This relationship establishes proper flow through the root turn 50. If the cross-sectional area at mouth 59 is less than the cross-sectional area of the third leg 48, then the cooling fluid flowing through the mouth 59 undergoes a sudden expansion that causes flow separation, recirculation, and pressure loss. Further, the flow of cooling fluids may not be able to fill the third leg 48 downstream of the root turn 50 when the cross-sectional area at mouth 59 is less than the cross-sectional area of the third leg 48.

The turbine blade cooling system 10 may also include one or more refresh holes 60, as shown in FIGS. 4 and 5. The refresh hole 60 may be positioned in the rib 52 proximate to an end of the rib 54 for injecting cooling fluid into the root turn 50 on an upstream side 62 of the root turn 50. The refresh hole 60 may be aligned such that a centerline 64 of the refresh hole is at an angle $\alpha$ with a value between about 15 degrees and about 75 degrees relative to the flow of cooling fluids through the second leg 46. In at least one embodiment, the angle $\alpha$ may be about 45 degrees. The refresh hole 60 may have a bell mouth inlet section 68 and a straight exit region 70 or a convergent section for pushing the flow. The mouth section 68 may be positioned to draw cooling fluids from the cavity 14 before the cooling fluid enters the serpentine cooling channel 42, which provides cooling fluids to the root turn 50 that have yet to pick up heat from the outer walls 22 of the turbine blade 20.

By including the refresh hole 60 proximate to the mouth 59 on the upstream portion of the root turn 50, the cooling fluids passing through the refresh hole 60 influence the cooling fluids flowing through the second leg 46 and into the root turn 50. In fact, the refresh hole 60 and root turn 50 reduces the pressure loss compared to conventional designs. The refresh hole 60 enables cooling fluids to bypass the first and second legs 44 and 46 and therefore enter the root turn 50 at a lower temperature than had the cooling fluids flowed through the first and second legs 44 and 46.

Figure 1:
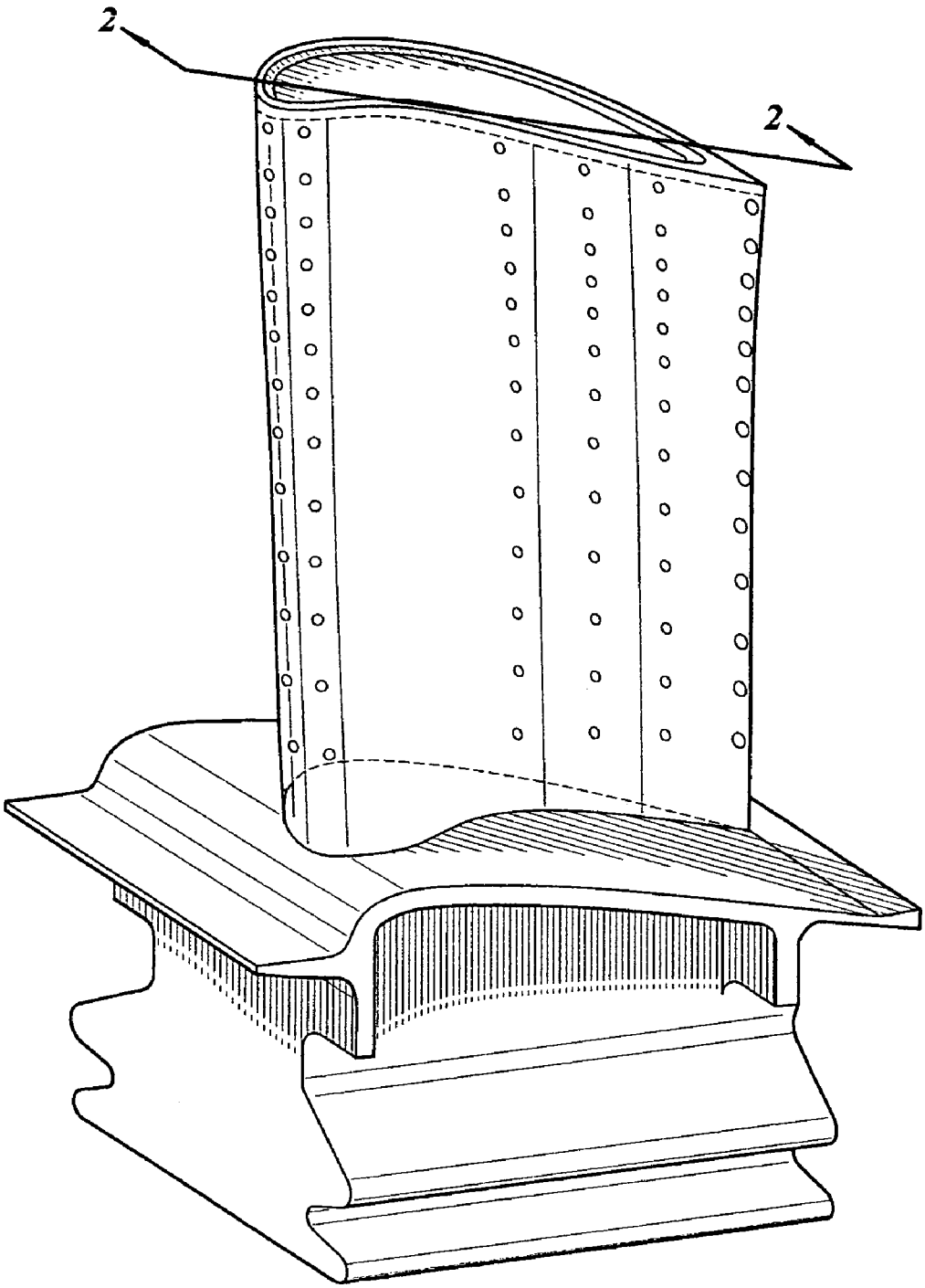
FIG. 1 (PRIOR ART)
FIG. 1 is a perspective view of a conventional turbine blade.
Figure 2:
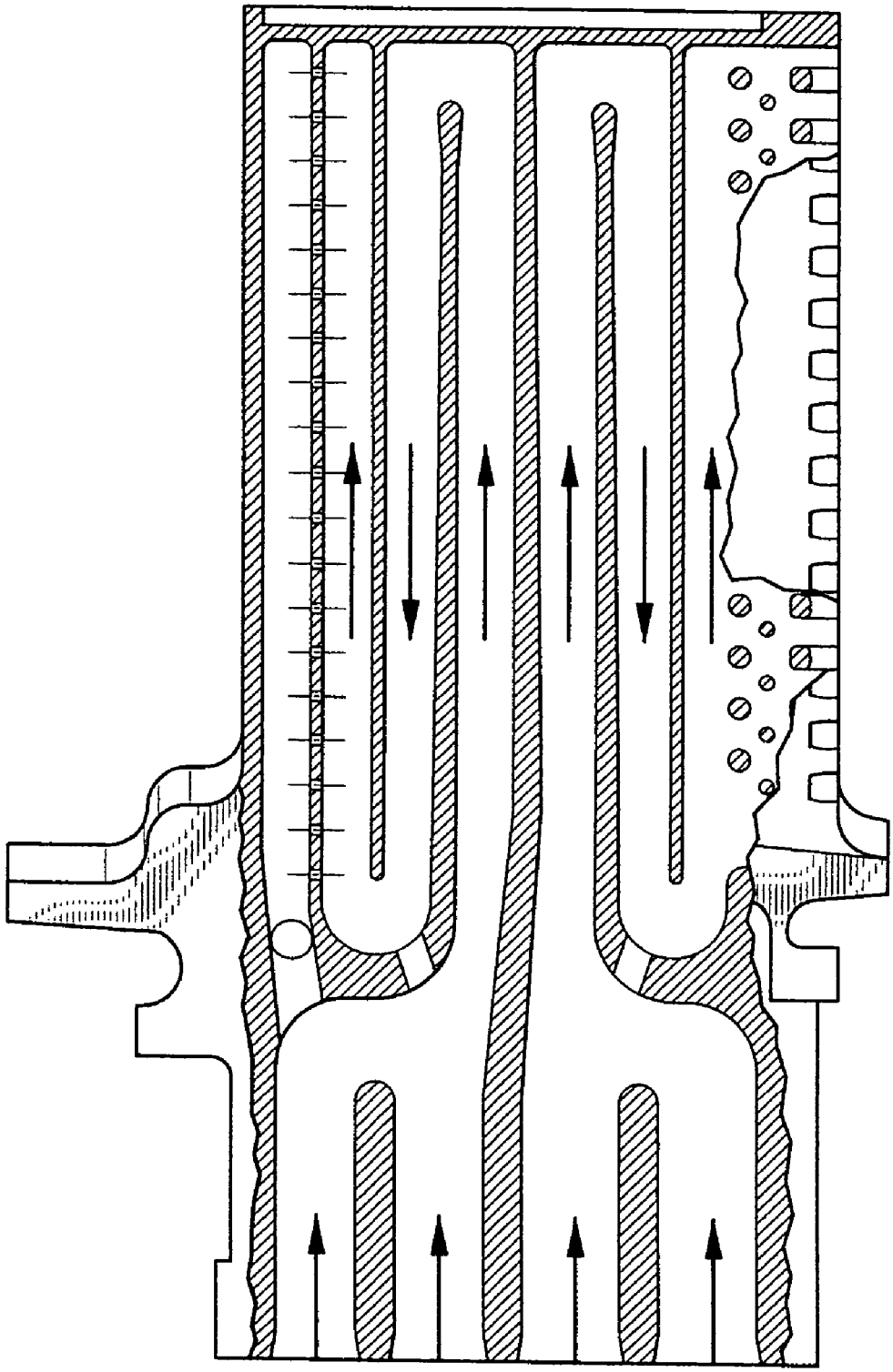
FIG. 2 (PRIOR ART)
FIG. 2 is a cross-sectional view of the conventional turbine blade shown in FIG. 1 taken along section line 2—2.

In operation, cooling fluids flow into the cooling cavity 14 through the root 16. A portion of the cooling fluids enter the first leg 44, pass into the second leg 46, and pass into the root turn 50. Simultaneously, cooling fluids pass through the refresh hole 60 and mix with the cooling fluids flowing from the second leg 46. The elimination of the conventional root turn geometry shown in FIG. 2 eliminates the constraint on the cooling fluid flow through a serpentine cooling channel, which allows the cooling fluid to form a free stream tube in the root turn 50. The embodiment shown in FIG. 4 has been shown to reduce pressure loss coefficient from 2.0 to about 0.6 as compared with a conventional root turn shown in FIG. 2.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, and a tip at a first end, a root coupled to the blade at an end generally opposite the first end for supporting the blade and for coupling the blade to a disc, at least one cavity forming a cooling system in the blade, and at least one outer wall defining the at least one cavity forming at least a portion of the cooling system;

wherein the cooling system comprises at least one serpentine cooling channel formed from a first leg extending generally from the root towards the tip, a second leg in communication with the first leg and extending towards the root, and a third leg in communication with the second leg through a root turn and extending generally towards the tip; and at least one refresh hole extending between the first leg and the second leg and positioned proximate to the root turn to direct cooling fluid into the upstream portion of the root turn;

wherein the at least one refresh hole is positioned between about 15 degrees and about 75 degrees relative to a direction of flow of the cooling fluid through the second leg and positioned immediately downstream of a mouth of an upstream portion of the turn.

2. The turbine blade of claim 1, wherein the at least one refresh hole is positioned at about 45 degrees relative to a direction of flow of the cooling fluid through the second leg.

3. The turbine blade of claim 1, wherein a cross-sectional area of the second leg proximate to the root turn is greater than the cross-sectional area of the third leg proximate to the root turn.

4. The turbine blade of claim 1, wherein a cross-sectional area of the second leg proximate to the root turn is equal to the cross-sectional area of the third leg proximate to the root turn.

5. The turbine blade of claim 1, wherein the at least one refresh hole is located on an upstream side of the root turn.

6. The turbine blade of claim 1, wherein the at least one refresh hole has a bell mouth inlet section and a straight exit region.

7. The turbine blade of claim 1, wherein the root turn is formed from a first rib extending from the root spanwise towards the tip and separating the first and second legs, a second rib extending from the root towards the tip and forming a portion of the third leg, and a third rib extending between the first and second ribs.

8. The turbine blade of claim 7, wherein the third rib is substantially straight.

9. The turbine blade of claim 7, wherein the third rib extends generally orthogonally to the first and second ribs such that the root turn is generally rectangular in shape.

10. The turbine blade of claim 7, wherein a spanwise length of the root turn is at least as long as about half of a length of the second leg of the serpentine cooling channel.

11. A turbine blade, comprising:

a generally elongated blade having a leading edge, a trailing edge, and a tip at a first end, a root coupled to the blade at an end generally opposite the first end for supporting the blade and for coupling the blade to a disc, at least one cavity forming a cooling system in the blade, and at least one outer wall defining the at least one cavity forming at least a portion of the cooling system;

wherein the cooling system comprises at least two serpentine cooling channels, each formed from a first leg extending generally from the root towards the tip, a second leg in communication with the first leg and extending towards the root, and a third leg in communication with the second leg through a root turn and extending generally towards the tip;

wherein the root turn is formed from a first rib extending from the root spanwise towards the tip and separating the first and second legs, a second rib extending from the root towards the tip and forming a portion of the third leg, and a substantially straight third rib extending between the first and second ribs; and at least one refresh hole in each of the at least two serpentine cooling channels extending between the first leg and the second leg and positioned proximate to the root turn to direct cooling fluid into the upstream portion of the root turn;

wherein the at least one refresh hole is positioned between about 15 degrees and about 75 degrees relative to a direction of flow of the cooling fluid through the second leg and positioned immediately downstream of a mouth of an upstream portion of the turn.

12. The turbine blade of claim 11, wherein the at least one refresh hole is positioned at about 45 degrees relative to a direction of flow of the cooling fluid through the second leg.

13. The turbine blade of claim 11, wherein a cross-sectional area of the second leg proximate to the root turn is greater than the cross-sectional area of the third leg proximate to the root turn.

14. The turbine blade of claim 11, wherein a cross-sectional area of the second leg proximate to the root turn is equal to the cross-sectional area of the third leg proximate to the root turn.

15. The turbine blade of claim 11, wherein the at least one refresh hole is located on an upstream side of the root turn.

16. The turbine blade of claim 11, wherein the at least one refresh hole has a bell mouth inlet section and a straight exit region.

* * * * *